US006345513B1

(12) United States Patent
Kim et al.

(10) Patent No.: US 6,345,513 B1
(45) Date of Patent: Feb. 12, 2002

(54) WALL MOUNTED AIR CONDITIONER

(75) Inventors: Jae-Soon Kim, Suwon; Kyo-Sung Hwang, Seoul, both of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/805,155

(22) Filed: Mar. 14, 2001

(30) Foreign Application Priority Data

Nov. 11, 2000 (KR) ..... 00-67000

(51) Int. Cl.[7] ..... F25D 23/12
(52) U.S. Cl. ..... 62/263; 62/267; 62/448
(58) Field of Search ..... 62/263, 267, 259.1, 62/298, 448, 440, 449

(56) References Cited

U.S. PATENT DOCUMENTS 3,308,634 A * 3/1967 Smith ..... 62/263
6,065,296 A 5/2000 Feger

* cited by examiner

*Primary Examiner*—William Doerrler
*Assistant Examiner*—Melvin Jones
(74) *Attorney, Agent, or Firm*—Robert E. Bushnell, Esq.

(57) ABSTRACT

Disclosed herewith is a wall mounted air conditioner. The air conditioner comprises an air conditioner body installed in an installation space of a building and provided with an exhaust hole on its top. A frame is situated in the installation space for guiding the installation and removal of the air conditioner body. A connecting duct is fitted into the air conditioner body and the frame to connect the exhaust hole of the air conditioner body to a duct mounted in the building when the air conditioner body is moved into the installation space. The wall mounted air conditioner can be easily moved into an installation space for installation and easily removed from the installation space for repair or replacement.

20 Claims, 6 Drawing Sheets

WALL MOUNTED AIR CONDITIONER

CLAIM OF PRIORITY

This application makes reference to, incorporates the same herein, and claims all benefits accruing under 35 U.S.C. §119 from my application entitled WALL INSIDE SETTING TYPE AIR CONDITIONER filed with the Korean Industrial Property Office on Nov. 11, 2000 and there duly assigned Ser. No. 2000/67000.

BACKGROUND OF THE INVENTION

1. Field of the Invention

The present invention relates generally to wall mounted air conditioners, and more particularly to a wall mounted air conditioner, which allows its air conditioner body to be easily installed in an installation space of a building and removed from the installation space.

2. Description of the Prior Art

In general, a wall mounted air conditioner is used to air-condition a small-scale building, one floor of a middle-scale building, a conference hall or a computer room while being connected to the duct system of a building.

As illustrated in FIG. 1, such a wall mounted air conditioner is installed in an installation space 1 on one side of a building. An inner wall 2 and an outer wall 6 define the installation space 1. An opening 4 is formed on the inner wall 2 to allow an air conditioner body 3 to be installed and removed. A door 5 having an inlet 5*a* is mounted in the opening 4. An opening 7 is formed in the outer wall 6 to allow outdoor air to enter the space, exchange heat with the air conditioner body 3 and flow out of the space.

The air conditioner body 3 is disposed in the installation space 1 with the outdoor air inlet and outlet 8 and 9 of the air conditioner body 3 facing the opening 7 of the outer wall 6 and the indoor air inlet 10 of the air conditioner body 3 facing the inlet 5*a* of the door 5. An exhaust hole 11 formed on the top of the air conditioner body 3 is connected to a duct 13 installed in a building. In this case, the duct 13 is connected to the exhaust hole 11 by means of an adhesive tape or a steel wire. The bottom of the air conditioner body 3 is supported by a plurality of support legs 14 on the bottom of the installation space 1.

When the conventional wall mounted air conditioner is installed in the installation space 1, the air conditioner body 3 is moved into the installation space 1 at a proper position and the exhaust hole 11 of the air conditioner body 3 is connected to the duct 13 of the building.

However, in the conventional wall mounted air conditioner, since the air conditioner body 3 is supported by a plurality of support legs 14, the air conditioner body 3 is difficult to move to the installation space 1 for installation and to remove out of the installation space 1 for repair or replacement.

Additionally, since the exhaust hole 11 of the air conditioner body 3 is connected to the duct 13 by means of an adhesive tape or a steel wire, the exhaust hole 11 and the duct 13 are difficult to connect to each other for installation and to disconnect from each other for repair or replacement.

SUMMARY OF THE INVENTION

Accordingly, the present invention has been made keeping in mind the above problems occurring in the prior art, and an object of the present invention is to provide a wall mounted air conditioner, which can be easily moved into an installation space for installation and easily removed from the installation space for repair or replacement.

Another object of the present invention is to provide a wall mounted air conditioner, which can be easily connected to a duct for installation and easily disconnected from the duct for repair or replacement.

In order to accomplish the above object, the present invention provides a wall mounted air conditioner, comprising: an air conditioner body installed in an installation space of a building and provided with an exhaust hole on its top; a frame situated in the installation space for guiding the installation and removal of the air conditioner body; and a connecting duct fitted into the air conditioner body and the frame for connecting the exhaust hole of the air conditioner body to a duct mounted in the building when the air conditioner body is moved into the installation space.

The frame may comprise: a plurality of lower rails arranged in parallel with each other in the moving direction of the air conditioner body; a plurality of pillars extended upwardly from the ends of the lower rails; and a top plate connected to the upper ends of the pillars, into which the connecting duct is fitted at a position corresponding to that of the exhaust hole.

The connecting duct may be comprised of first and second connecting duct parts, the first connecting duct part being mounted to the top plate with its upper portion upwardly extended and connected to the duct and its lower portion downwardly extended, the second connecting duct part being upwardly extended from the exhaust hole, the first connecting duct part being provided with a first extended portion extended downwardly from the rear half of the first connecting duct part to cover the rear half of the second connecting duct part, the second connecting duct part being provided with a second extended portion extended upwardly from the front half of the second connecting duct part to cover the front half of the first connecting duct part.

The first and second extended portions may be each provided with a sealing member to maintain air-tightness therebetween.

The first and second connecting duct parts may each have a circular cross-section.

The first half of one of the first and second connecting duct parts may have an inner diameter identical with the outer diameter of the remaining connecting duct part, while a second half may have an outer diameter identical with the inner diameter of the remaining connecting duct part.

The first and second connecting duct parts are each provided with connecting projections and connecting recesses respectively to ensure the connection therebetween.

The wall mounted air conditioner may further comprise a plurality of upper rails, the upper rails being formed on the bottom of the air conditioner body to correspond to the lower rails of the frame, the upper and lower rails being provided with longitudinal guide projections that are engaged with each other to prevent the air conditioner body from being displaced laterally during the movement of the air conditioner body.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DESCRIPTION OF THE PREFERRED EMBODIMENTS

Figure 1:
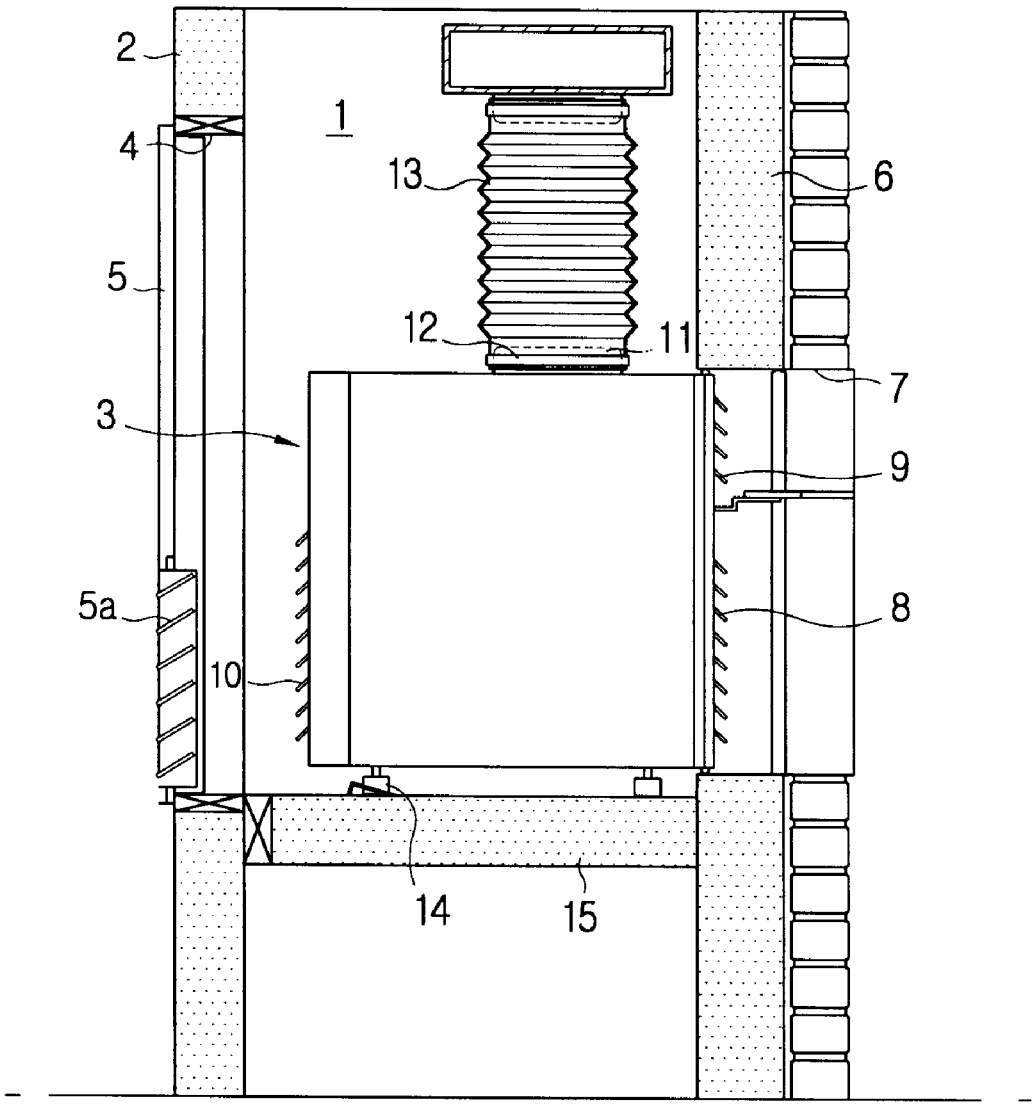
FIG. 1 (PRIOR ART)
FIG. 1 is a cross section showing the structure of a conventional wall mounted air conditioner.

Reference now should be made to the drawings, in which the same reference numerals are used throughout the different drawings to designate the same or similar components.

Figure 2:
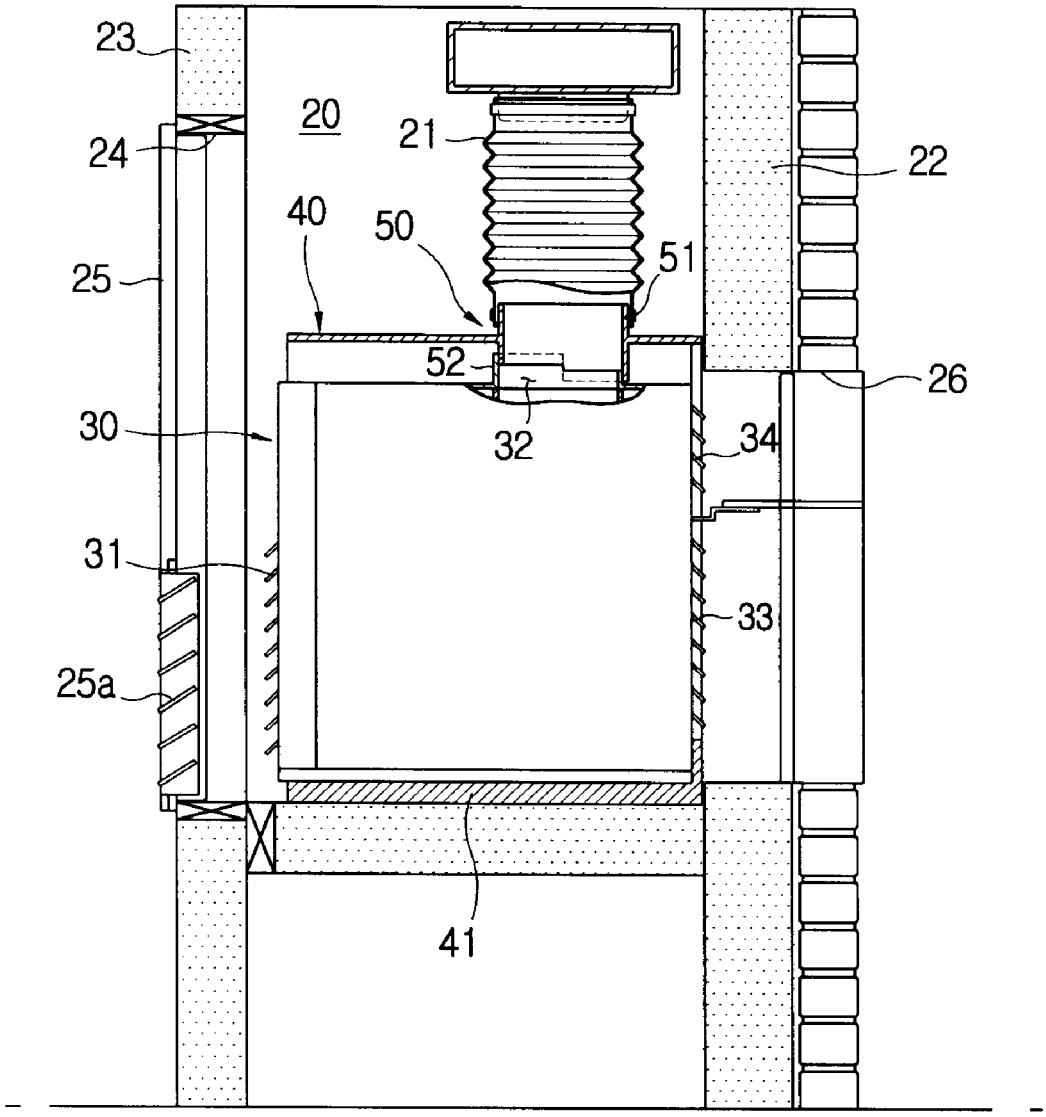
FIG. 2 is a cross section showing the structure of a wall mounted air conditioner in accordance with the present invention.

As depicted in FIG. 2, a wall mounted air conditioner of the present invention serves to supply exhausted, air-conditioned air to an indoor space through a duct 21 mounted in a building. The wall mounted air conditioner is generally installed in an installation space 20 prepared in the corner or the spare space of the building.

The installation space 20 is defined by an outer wall 22 and an inner wall 23. The inner wall 23 is spaced inwardly apart from the outer wall 22 to allow the installation space 20 to accommodate the air conditioner body 30 of the wall mounted air conditioner. An opening 24 having a width and a height larger than those of the air conditioner body 30 is formed on the inner wall 23 to allow the air conditioner body 30 to be installed in the installation space 20 and to be removed from the installation space 20. A door 25 is openably mounted in the opening 24. The door 25 is provided with an inlet 25*a* having a plurality of louvers to suck indoor air into the air conditioner body 30. An opening 26 is formed in the outer wall 22 to allow outdoor air to enter the installation space 20, exchange heat with the air conditioner body 30 and flow out of the installation space 20.

Although not shown in the drawings, the air conditioner body 30 is comprised of cooling means including an evaporator, a compressor and a condenser, air circulating means for circulating indoor and outdoor air, and heating means for supplying hot air upon a user's selection. An indoor air inlet 31 is formed on the front of the air conditioner body 30 to suck indoor air, an exhaust hole 32 is formed on the top of the air conditioner body 30 to exhaust air-conditioned indoor air, and an outdoor air inlet 33 and an indoor air outlet 34 are formed on the rear of the air conditioner body 30 to suck and discharge outdoor air.

The air conditioner body 30 is positioned in the installation space 20, with the outdoor air inlet and outlet 33 and 34 formed on the rear of the air conditioner body 30 facing the opening 26 formed on the outer wall 22 of the building and the indoor air inlet 31 formed on the front of the air conditioner body 30 facing the inlet 25*a* of the door 25. The exhaust hole 32 is connected to a duct 21 that is arranged in the building.

The wall mounted air conditioner of the present invention is characterized by slide guide means and a frame 40. The slide guide means serves to allow the air conditioner body 30 to easily enter the installation space 20 when the air conditioner body 30 is installed in the installation space 20. The frame 40 is provided with a connecting duct 50, which automatically connects the duct 21 with the exhaust hole 32 or disconnects the duct 21 from the exhaust hole 32 when the air conditioner body 30 is installed or removed.

Figure 3:
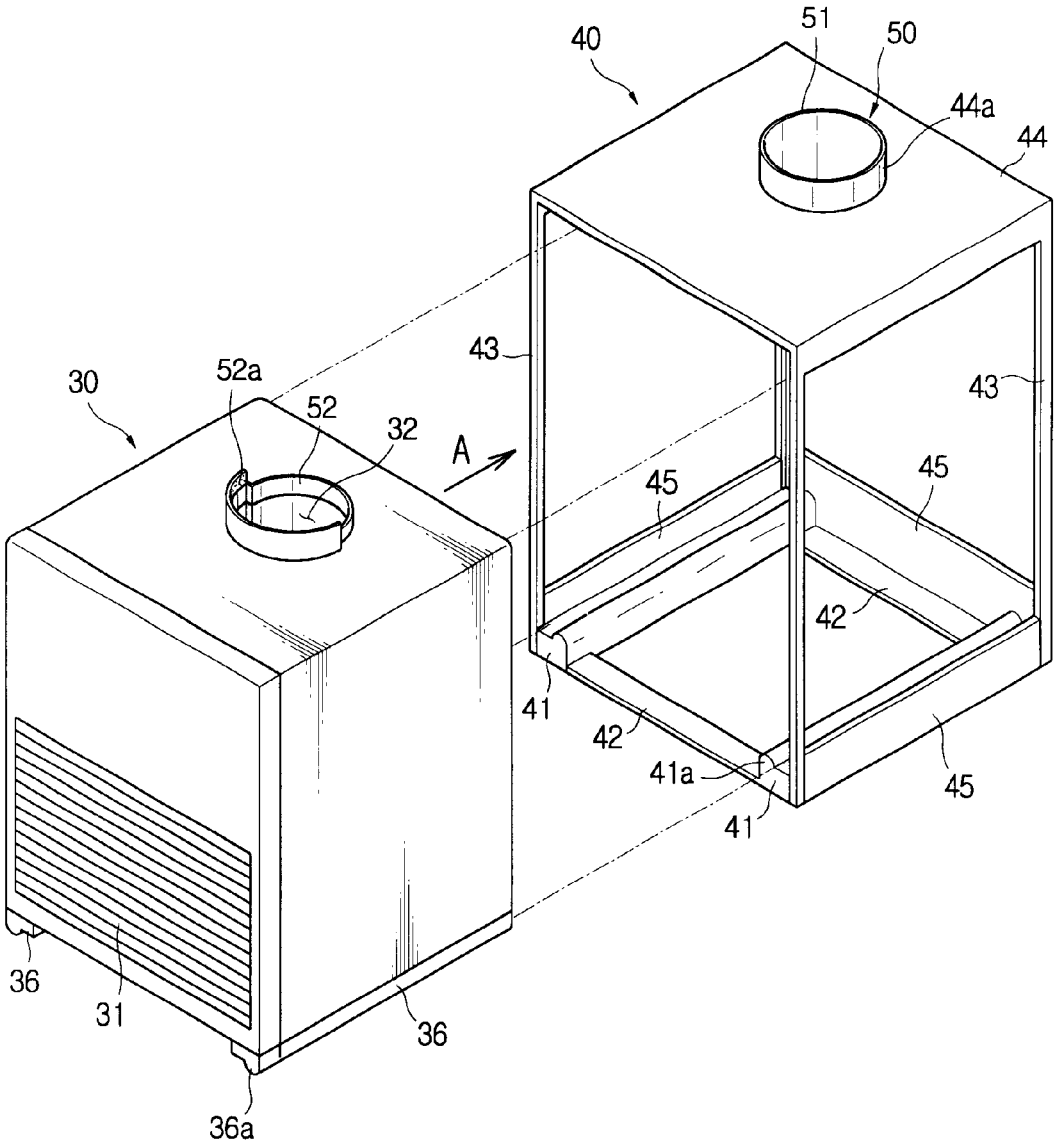
FIG. 3 is a perspective view of the air conditioner of the present invention with its air conditioner body and its frame separated from each other.
Figure 4:
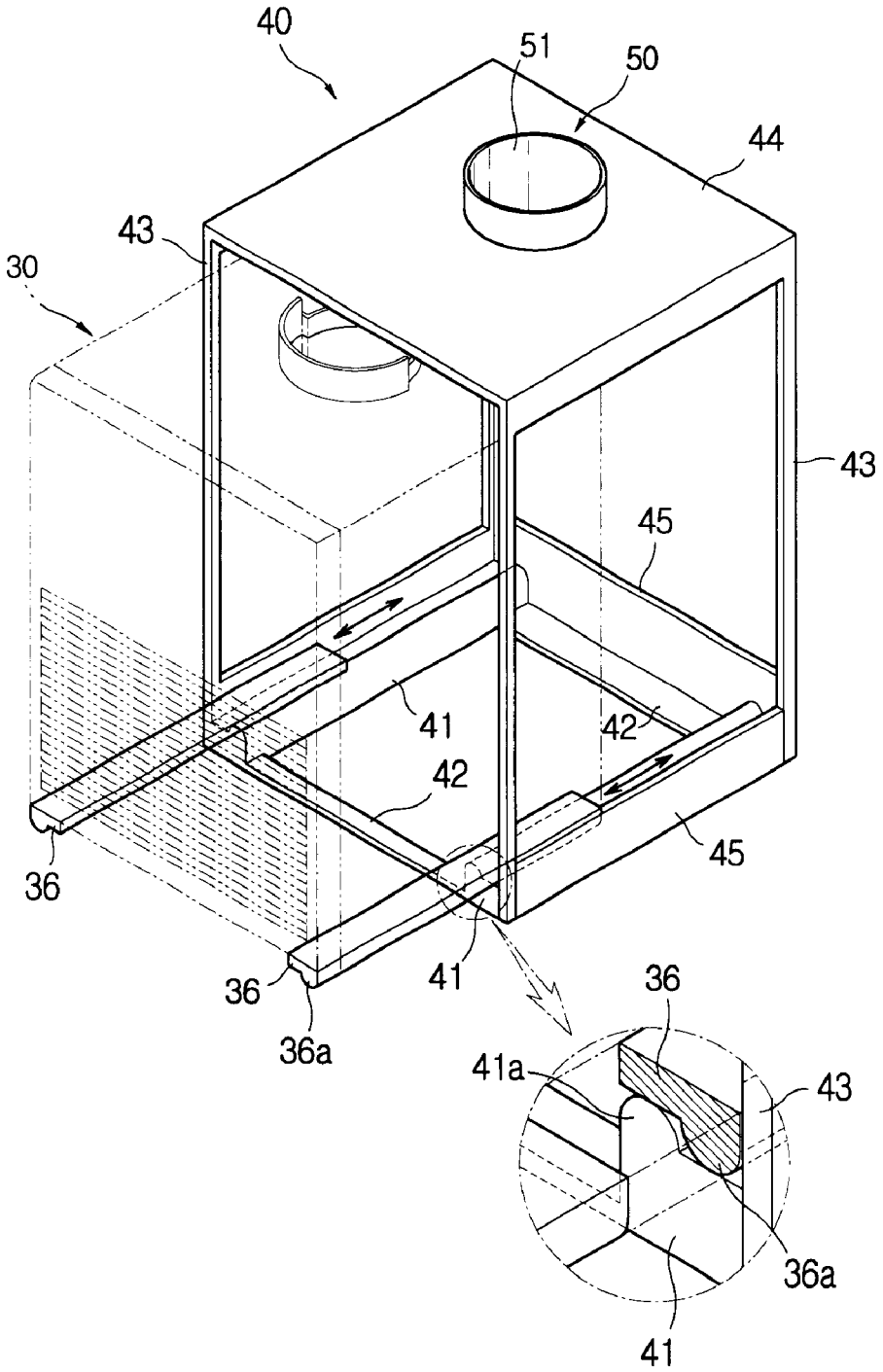
FIG. 4 is a perspective view showing a state in which the air conditioner body is moved into the frame.

The frame 40, as shown in FIGS. 3 and 4, is comprised of a pair of lower rails 41, a pair of connecting members 42, a plurality of pillars 43 and a top plate 44. The lower rails 41, together with a pair of upper rails 36, constitute the slide guide means. The connecting members 42 each connect the opposite ends of the lower rails 41. The pillars 43 each extend from the ends of the lower rails 41. The top plate 44 is connected to the upper ends of the pillars 43, and covers the air conditioner body 30. The connecting duct 50 is fitted into the top plate 44.

The lower rails 41 are arranged in parallel with each other in the moving direction of the air conditioner body 30 ("A"direction) while being spaced apart from each other, so as to allow the air conditioner body 30 to slide. A pair of upper rails 36 are attached to the side ends of the bottom of the air conditioner body 30 at positions corresponding to those of lower rails 41. In order to prevent the air conditioner body 30 from vibrating and facilitate the desirable guidance of the air conditioner body 30, two pairs of guide projections 36*a* and 41*a* are formed on the upper and lower rails 36 and 41, respectively. In this case, the pairs of guide projections 36*a* and 41*a* are formed on the bottom surface of the upper rails 36 and the top surface of the lower rails 41, respectively, and each have a circular cross-section to minimize friction between the air conditioner body 30 and the frame 40.

The connecting members 42 are each arranged in the direction crossing the lower rails 41 to connect each pair of opposite ends of the lower rails 41 together, and serve to keep the interval of the lower rails 41 constant and to strengthen the structure of the frame 40. In this case, the connecting members 42 are connected to the lower portions of the lower rails 41 so as to prevent the movement of the air conditioner body 30 from being obstructed by the connecting members 42.

The pillars 43 each extend from each end of the lower rails 41, and serve to support the top plate 44. The distances between the pillars 43 are determined so as to cause the size of the frame 40 to be larger than the size of the air conditioner body 30, so the air conditioner body 30 can enter the interior of the frame 40 and be removed from the interior of the frame 40.

In addition, three reinforcing plates 45 each having a height higher than that of the lower rails 41 are attached to the outer sides and the rear ends of the lower rails 41 to enhance the structure of the frame 40 and stop the air conditioner body 30 within the frame 40. The reinforcing plates 45 connect the lower rails 41, the connecting members 42 and the pillars 43 to one another.

Figure 6:
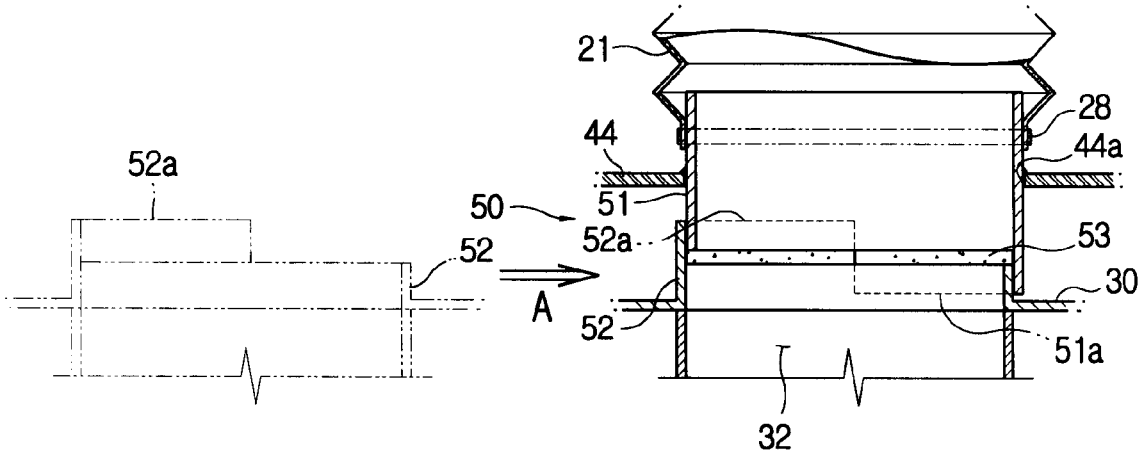
FIG. 6 is a cross section showing a state in which the first and second connecting duct parts of the connecting duct of the present invention are engaged with each other.

The top plate 44 is comprised of a rectangular plate larger than the top of the air conditioner body 30. The top plate 44 covers the top of the air conditioner body 30, and is connected to the upper ends of the pillars 43 at its four corners. As shown in FIG. 6, a through hole 44*a*, into which the connecting duct 50 is fitted, is formed on the top plate 44 at a position corresponding to that of the exhaust hole 32 of the air conditioner body 30. Although the top plate 44 is described as being connected to the upper ends of the pillars 43 to hold the connecting duct 50, the upper portions of the pillars 43 can be bent toward the connecting duct 50 and the connecting duct 50 can be held by the pillars 43.

Figure 5:
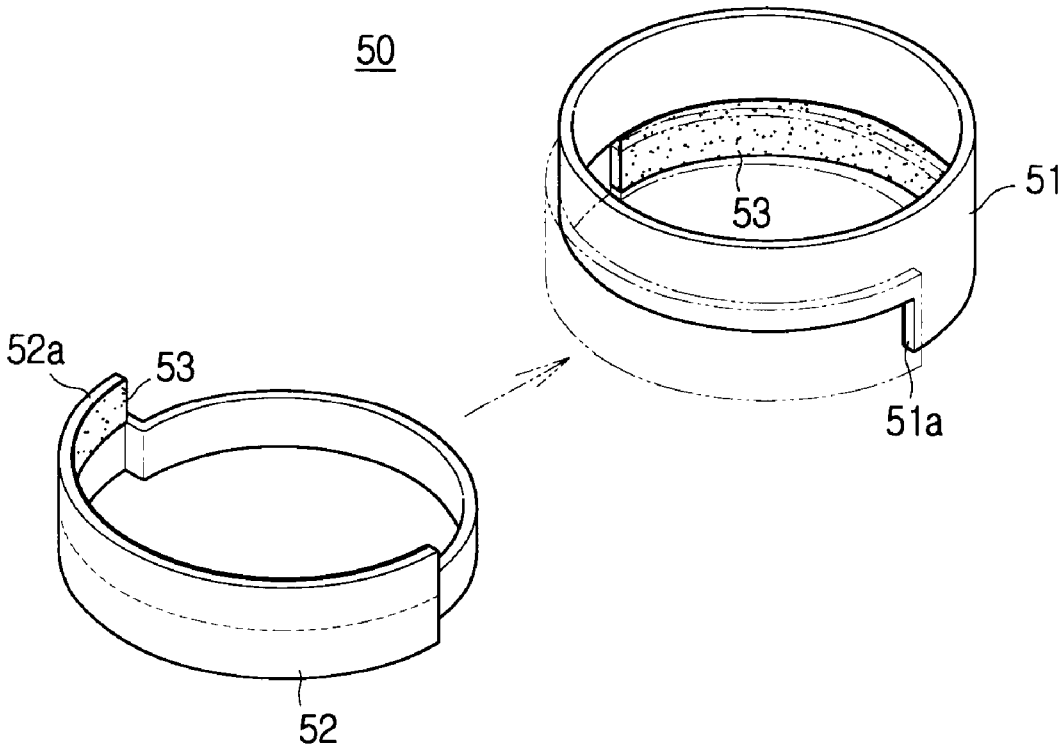
FIG. 5 is a perspective view showing a connecting duct of the present invention.

As depicted in FIGS. 5 and 6, the connecting duct 50 is comprised of a first connecting duct part 51 and a second connecting duct part 52, which are engaged with each other when the air conditioner body 30 is moved into the frame 40. The first connecting duct part 51 is fitted into the through hole 44*a* of the top plate 44, with its upper portion upwardly extended and connected to the duct 21 of the building and its lower portion downwardly extended toward the exhaust hole 32 of the air conditioner body 30. The upper portion of the first connecting duct part 51 is connected to the duct 21 of the building by means of an adhesive tape or a steel wire when the frame 40 is initially installed in the installation space 20. The second connecting duct part 52 is upwardly extended from the exhaust hole 32 of the air conditioner body 30 toward the first connecting duct part 51.

A first extended portion 51*a* is downwardly extended from the rear half of the first connecting duct part 51, so as to cover the rear half of the second connecting duct part 52 when the air conditioner body 30 is moved into the installation space 20. A second extended portion 52*a* is upwardly extended from the front half of the second connecting duct part 52, so as to cover the front half of the first connecting duct part 51 when the air conditioner body 30 is moved into the installation space 20. In addition, connecting projections 51*b* and connecting recesses 52b are formed at the inner surfaces of the first connecting duct parts 51 and outer surfaces of the second connecting duct parts 52, respectively, so as to ensure the connection between the first and second connecting duct parts 51 and 52 when the first and second connecting duct parts 51 and 52 are engaged with each other.

Sealing members 53 are attached to the inner surfaces of the first and second extended portions 51*a* and 52*a*, so as to maintain air-tightness between the first and second connecting duct parts 51 and 52 when the first and second connecting duct parts 51 and 52 are engaged with each other. This structure causes the first and second connecting duct parts 51 and 52 to partially overlap by means of the first and second extended portions 51*a* and 52*a*. As the air conditioner body 30 is guided into the frame 40 along the lower rails 41, the first connecting duct part 51 is brought into contact and air-tightly engaged with the second connecting duct part 52.

Although the plan shape of the first and second connecting duct parts 51 and 52 is described as being circular in consideration of easy engagement, air-tightness and the strength of structure, the polygonal plan shape of the first and second connecting duct parts 51 and 52 does not prevent the object of the present invention form being accomplished.

In order to allow the first connecting duct part 51 to be brought into tight contact with the second connecting duct part 52, it is preferable that the inner diameter of the front half of the second connecting duct part 52 coincides with the outer diameter of the first connecting duct 51 and the outer diameter of the rear half of the second connecting duct part 52 coincides with the inner diameter of the first connecting duct part 51. In this case, both halves of the second connecting duct parts 52 have different diameters and both halves of the first connecting duct parts 51 have the same diameter. It does not make a difference if both halves of the first connecting duct parts 51 have different diameters and both halves of the second connecting duct parts 52 have the same diameter. Alternatively, the first and second connecting duct parts 51 and 52 can be engaged with each other in such a way that both halves of the first connecting duct parts 51 and both halves of the second connecting duct parts 52 each have different diameters.

Hereinafter, the installation and removal of the wall mounted air conditioner are described.

In order to install the air conditioner body 30 in the installation space 20, the frame 40 is moved into the installation space 20 and secured thereto, and the upper portion of the first connecting duct 51 fitted into the top plate 44 of the frame 40 is connected to the duct 21 mounted in the building by means of an adhesive tape or a steel wire.

Thereafter, while the door 25 mounted in the inner wall 23 of the building is open, the air conditioner body 30 is slid into the frame 40 along the lower rails 41 of the frame 40. At this time, the air conditioner body 30 is moved rearward with the guide projections 36*a* of the upper rails 36 engaged with the guide projections 41*a* of the lower rails 41, so the air conditioner body 30 is easily guided rearward and is not displaced laterally. Additionally, when the air conditioner body 30 completely enters the frame 40, the lower end portions of the air conditioner body 30 are brought into contact with the reinforcing plates 45, thereby positioning the air conditioner body 30 at a proper location.

In addition, as the air conditioner body 50 is moved into the frame 40, the second connecting duct part 52 upwardly extended from the top of the air conditioner body 30 is engaged with the first connecting duct part 51 fitted into the top plate 44 of the frame 40, thus allowing the first and second connecting duct parts 51 and 52 to be engaged with each other without special operation. That is, the air conditioner body 30 is installed and connected to the duct 21 at the same time by moving the air conditioner body 30 into the frame 40.

In order to remove the air conditioner body 30 from the installation space 20 for repair or replacement, the air conditioner body 30 is pulled from the installation space 20. At this time, the air conditioner body 30 is easily drawn out of the installation space 20 along the lower rails 41, and simultaneously the second connecting duct part 51 is easily separated from the first connecting duct part 52.

As described above, the present invention provides a wall mounted air conditioner, which can be easily moved into an installation space for installation and easily removed from the installation space for repair or replacement.

In addition, the present invention provides a wall mounted air conditioner, which can be easily connected to a duct for installation and easily disconnected from the duct for repair or replacement.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A wall mounted air conditioner, comprising:

an air conditioner body installed in an installation space of a building and provided with an exhaust hole;

a frame disposed in said installation space for guiding the installation and removal of said air conditioner body;

a connecting duct fitted into said air conditioner body and said frame for connecting said exhaust hole of the air conditioner body to a duct mounted in the building when said air conditioner body is moved into said installation space; and said frame comprising:

a plurality of lower rails arranged in parallel with each other in the moving direction of said air conditioner body;

a plurality of pillars extended upwardly from respective ends of said lower rails; and a top plate connected to upper ends of said pillars, into which said connecting duct is fitted at a position corresponding to that of said exhaust hole.

2. The wall mounted air conditioner according to claim 1, wherein said connecting duct is comprised of first and second connecting duct parts, said first connecting duct part being mounted to said top plate with its upper portion upwardly extended and connected to said duct and its lower portion downwardly extended, said second connecting duct part being upwardly extended from said exhaust hole, said first connecting duct part being provided with a first extended portion extended downwardly from the rear half of said first connecting duct part to cover the rear half of said second connecting duct part, said second connecting duct part being provided with a second extended portion extended upwardly from the front half of said second connecting duct part to cover the front half of said first connecting duct part.

3. The wall mounted air conditioner according to claim 2, wherein said first and second extended portions are each provided with a sealing member to maintain air-tightness therebetween.

4. The wall mounted air conditioner according to claim 2, wherein said first and second connecting duct parts each have a circular cross-section.

5. The wall mounted air conditioner according to claim 2, wherein the first half of one of said first and second connecting duct parts has an inner diameter identical with the outer diameter of the remaining connecting duct part, while the second half has an outer diameter identical with the inner diameter of the remaining connecting duct part.

6. The wall mounted air conditioner according to claim 2, wherein said first and second connecting duct parts are each provided with connecting projections and connecting recesses respectively to ensure the connection therebetween.

7. The wall mounted air conditioner according to claim 1, further comprising a plurality of upper rails, said upper rails being formed on the bottom of said air conditioner body to correspond to the lower rails of said frame, said upper and lower rails being provided with longitudinal guide projections that are engaged with each other to prevent said air conditioner body from being displaced laterally during the movement of said air conditioner body.

8. A wall mounted air conditioner, comprising:

an air conditioner body having an exhaust hole;

a frame having a hollow inside accommodating said air conditioner body, rails arranged to guide said air conditioner body slidably inserted into said hollow inside from an outside of said frame, a plate coupled to and spaced-apart from said rails, and a first connecting duct formed on said plate and extended toward said hollow inside; and a second connecting duct upwardly extended from a side defining said exhaust hole of said air conditioner body, mating with said first connecting duct when said air conditioner body is inserted into said hollow inside along said rails.

9. The wall mounted air conditioner of claim 8, further comprising a first extension extended from said first connecting duct, said first extension covering a portion of said second connecting duct when said first connecting duct is connected to said second connecting duct.

10. The wall mounted air conditioner of claim 9, with said first connecting duct comprising a first half duct and a second half duct coupled to said first half duct, said first half duct having a first radius greater than a second radius of said second half duct, said first extension extended from said first half duct.

11. The wall mounted air conditioner of claim 9, further comprising:

a projection formed on said first extension; and a recess formed on said second connecting duct, said projection inserted into said recess when said first connecting duct is coupled to said second connecting duct.

12. The wall mounted air conditioner of claim 8, further comprising a second extension extended from said second connecting duct, said second extension covering a portion of said first connecting duct when said first connecting duct connected to said second connecting duct in response to the insertion of said air conditioner body into said hollow inside of said frame.

13. The wall mounted air conditioner of claim 12, with said second connecting duct having the same radius as a portion of said first connecting duct.

14. The wall mounted air conditioner of claim 8, further comprising:

a first extension extended from said first connecting duct; and a second extension extended from said second connecting duct, disposed in a diametric opposition of said first extension when said first connecting duct is coupled to said second connecting duct.

15. The wall mounted air conditioner of claim 14, said first extension covering a portion of an outer circumferential surface of said second connecting duct while said second extension covers a portion of an outer circumferential surface of said first connecting duct.

16. The wall mounted air conditioner of claim 15, further comprising a seal member disposed between said first extension and said second connecting duct and between said second extension and said first connecting duct.

17. The wall mounted air conditioner of claim 8, further comprising a plurality of pillars coupled between said plate and respective ends of said rail.

18. The wall mounted air conditioner of claim 8, further comprising a second rail formed on said air conditioner body, said second rail mating with said rail when said air conditioner body is inserted into said hollow inside along said rail.

19. The wall mounted air conditioner of claim 8, further comprising:

a plurality of first rails formed on said frame; and a plurality of second rails formed on said air conditioner body and being guided by corresponding one of said first rails when said air conditioner body is inserted into said hollow inside along said first rails.

20. The wall mounted air conditioner of claim 8, further comprising:

a projection formed on said first connecting duct; and a recess formed on said second connecting duct and receiving insertion of said projection.

* * * * *